US005217222A

United States Patent [19]

Rudell et al.

[11] Patent Number: 5,217,222

[45] Date of Patent: Jun. 8, 1993

[54] TOY RACKET WITH SOUND RESONATING MEMBRANE

[76] Inventors: Elliot Rudell, 1619 Gramercy Ave., Torrance, Calif. 90501; George Foster, 2700 Panorama Dr., Signal Hill, Calif. 90806

[21] Appl. No.: 915,785

[22] Filed: Jul. 16, 1992

Related U.S. Application Data

[63] Continuation of Ser. No. 529,512, May 29, 1990, abandoned.

[51] Int. Cl.[5] ..... A63B 59/00

[52] U.S. Cl. ..... 273/67 R; 84/418

[58] Field of Search ..... 273/67 R, 73 R, 67 B, 273/72 R, 26 B, 76, DIG. 8, 73 D, 73 L, 61 A; 84/418

[56] References Cited

U.S. PATENT DOCUMENTS

| | | | |
|---|---|---|---|
| 1,700,251 | 1/1929 | Contolini | 273/67 B |
| 3,048,399 | 8/1962 | Breitbach | 273/67 R |
| 3,185,479 | 5/1965 | Ortega . | |
| 3,620,118 | 11/1971 | Koishikawa | 84/418 |
| 3,998,457 | 12/1976 | Dempsey et al. | 273/73 D |
| 4,330,124 | 5/1982 | Vettorello | 84/418 |
| 4,462,589 | 7/1984 | Morgan | 273/DIG. 8 |

FOREIGN PATENT DOCUMENTS

| | | | |
|---|---|---|---|
| 282936 | 2/1966 | Australia | 273/67 R |
| 2809296 | 9/1979 | Fed. Rep. of Germany | 273/61 A |
| 496281 | 10/1919 | France . | |
| 626408 | 10/1961 | Italy . | |
| 7359 | of 1902 | United Kingdom | 273/76 |
| 22453 | of 1902 | United Kingdom | 273/76 |
| 16681 | of 1903 | United Kingdom . | |

OTHER PUBLICATIONS

Bongo Ball, 1990 advertisement.

Exhibit A is an advertisement for "Bongo Ball", apparently sold by Peter Pan Playthings.

*Primary Examiner*—Mark S. Graham

*Attorney, Agent, or Firm*—Willian Brinks Olds Hofer Gilson & Lione

[57] ABSTRACT

There is disclosed a racket having a perimeter frame with a tympanum stretched across the frame and formed of a flexible film tautly stretched within the frame, thereby forming a sound-reverberating and resonating ball impact surface, and a handle which extends outwardly from the frame. Preferably the film is transparent and bears graphics or printed matter. The racket is used in a game utilizing a soft plastic foam ball of an elastomer which is struck by the racket using one or more players who participate by striking the ball repeatedly during the game.

22 Claims, 4 Drawing Sheets

TOY RACKET WITH SOUND RESONATING MEMBRANE

This application is a continuation, of application Ser. No. 07/529,512, filed May 29, 1990 now abandoned.

FIELD OF INVENTION

This invention relates to an activity and sport game and, more particular, to an activity game in which a ball is struck with a sound resonating racket.

Description of the Prior Art

There are many sport activity games in which the players strike a ball with rackets or paddles, returning the ball to a fellow-player or opponent, such as tennis, ping pong, racquetball, etc. In the toy sport activity market, Milton Bradley Company currently markets a product called "BATTLEBALL" wherein each opponent strikes a soft ball with a racket formed of a opaque rigid plastic disc supported at the end of a rod approximately one yard long. There is also a one-person activity game which has been marketed for years that uses a wooden paddle to which is affixed an elastic band with a rubber ball tethered to its opposite end. The player strikes the ball causing it to bounce from the racket and immediately return under the tension of the elastic band.

In most sport activity games, the rackets are formed of an open mesh weaving of plastic and resilient cord with the objective of imparting maximum rebound of the ball when struck with the racket. In none of the sport activities utilizing paddles or rackets has there been any attempt to impart sound-resonating quality and sound volume to the game by the use of highly resonating materials for the paddle or ball.

SUMMARY OF THE INVENTION

This invention comprises a racket having a perimeter frame with a tympanum stretched across the frame and formed of a flexible film tautly stretched within the frame, thereby forming a sound-reverberating and resonating ball impact surface, and a handle which extends outwardly from the frame. The invention is used in a game utilizing a soft plastic foam ball of an elastomer which is struck by the racket using one or more players who participate by striking the ball repeatedly during the game.

BRIEF DESCRIPTION OF THE DRAWINGS

The invention will be described with reference to the figures of which.

DESCRIPTION OF PREFERRED EMBODIMENT

Figure 1:
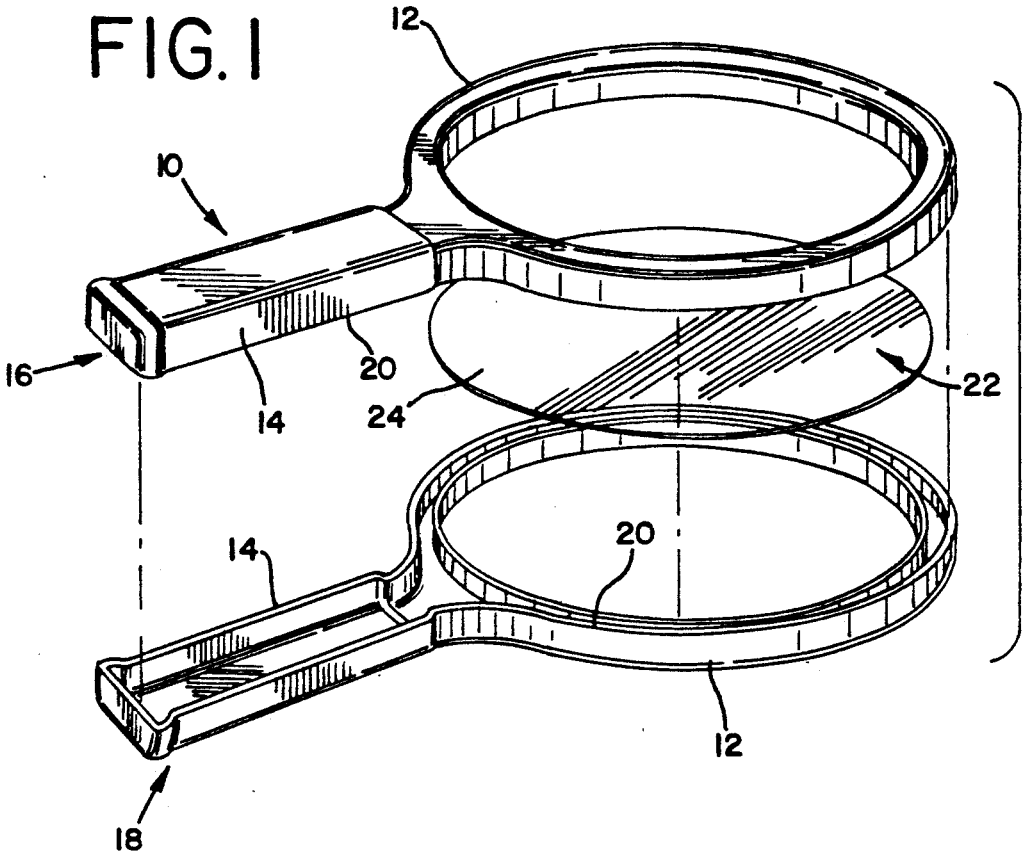
FIG. 1 is an exploded perspective of the racket used in the invention.

Referring to FIG. 1, the toy racket 10 of the invention is illustrated in an exploded perspective view. As there illustrated, the racket is formed of an outer or peripheral frame 12 which can be of any suitable shape, e.g., circuitous, oval, etc. The illustration shows a circuitous frame from which depends an outwardly extending handle 14. The frame 12 and handle 14 can be integral and hollow form, as shown. In this embodiment, the frame 12 and handle 14 are constructed by the assembly of two mirror-image halves 16 and 18 which are joined along a longitudinal mid-line 20 of the racket 10

The frame 12 provides the structural strength for the tension that is applied to the tympanum 22 which is formed of a thin, preferably flexible plastic membrane 24. The membrane 24 is received between the opposed frame member halves 16 and 18, and is stretched tautly by the frame 12 so as to impart a highly reverberating or resonating quality to the membrane 24. In the illustrated embodiment, the two halves of the racket can be joined with any suitable joint or can be solvent or cement-bonded or welded thermally or ultrasonically along the longitudinal mid-line 20.

The racket 10 can be formed of any suitable durable and strong material. If formed of plastics, various plastics such as polystyrene, polypropylene, high density polyethylene, etc. can be used and these plastics can, if desired, be reinforced with a suitable fibrous reinforcing material such as fiberglass, carbon and graphite fibers, etc. When formed of plastics, the racket halves 16 and 18 are preferably injection-molded for low cost and ease of manufacturing. The racket halves 16 and 18 can also be formed of other materials such as metals, e.g. steel, stainless steel, aluminum, magnesium, etc. If formed of metal, the mid-line seam between the two halves of the racket can be joined by welding using either spot welding or a continuous welded seam.

Preferably the tympanum 22 is formed of a flexible plastic membrane 24, which when tautly stretched will exhibit a high resonating and reverberating quality. Examples of suitable plastics for this purpose are polyethylene, and Mylar ®, i.e., polyester film. The polyester film is most preferred because of its high strength and very high resonating qualities. The membrane 24 has a thickness from about 0.002 to about 0.02 inch, preferably from about 0.05 to about 0.01 inch. In the most preferred embodiment, a transparent plastic film is used, since this provides free view through the racket and creates the illusion of an open racket. Also, printed matter, graphics, etc., can be placed on the film. When the film is transparent, the printed matter or graphics will be visible from both sides.

Figure 2:
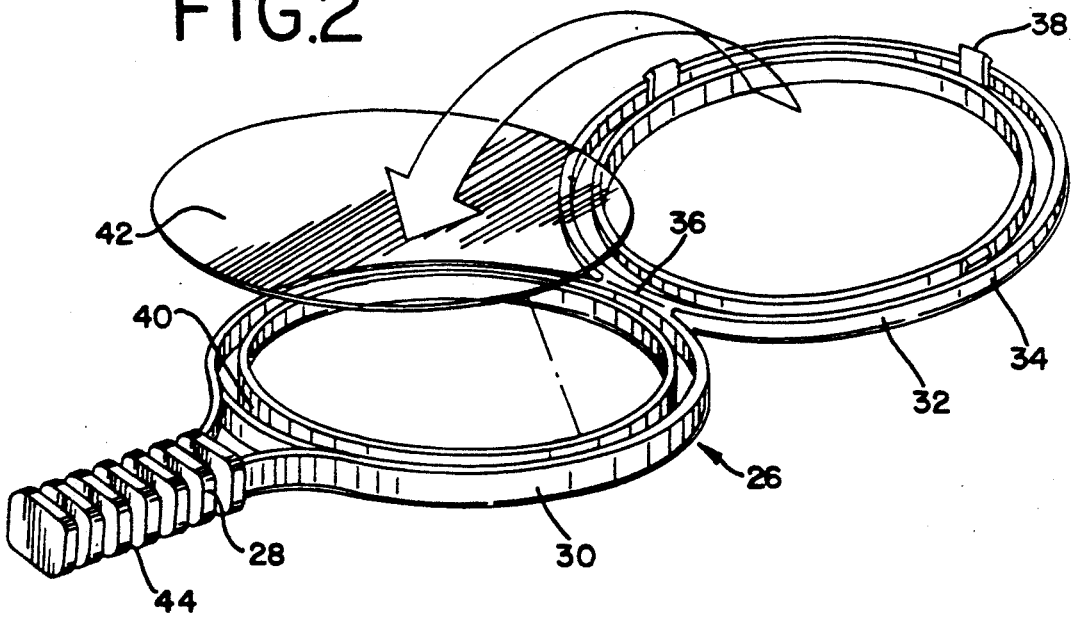
FIG. 2 is a perspective view of an alternative racket construction.

Referring to FIG. 2, there is illustrated an alternative embodiment of the invention. In this alternative embodiment, the racket 26 is formed with a single piece handle 28 which can be solid or hollow form, and which is formed and dependent from one half 30 of the frame 32. The other half frame member 34 is attached to the frame half 30 with a hinge 36. The hinge 36 can be integral with the frame halves 30 and 34, and can be formed during the molding of the plastic frame halves 30 and 34. This is particularly suitable for fabrication with a plastic such as polypropylene which has a sufficient high strength and durability for a hinge construction. The racket halves 30 and 34 can be interlocked by various means such as the multiple prongs 38 that are spaced at angular increments about the hinged frame half 34, and that seat in corresponding and appropriately located slots 40 in the lower frame member 30. As with the example shown in FIG. 2, racket 26 also has a tympanum 42 which is secured between the opposed frame halves 30 and 34, and which is tautly stretched between these frame halves to impart the desirable resonating and reverberating sound characteristics. As illustrated, the handle 28 can be provided with ribs 44 which extend transversely and completely about the handle 28.

Figure 3:
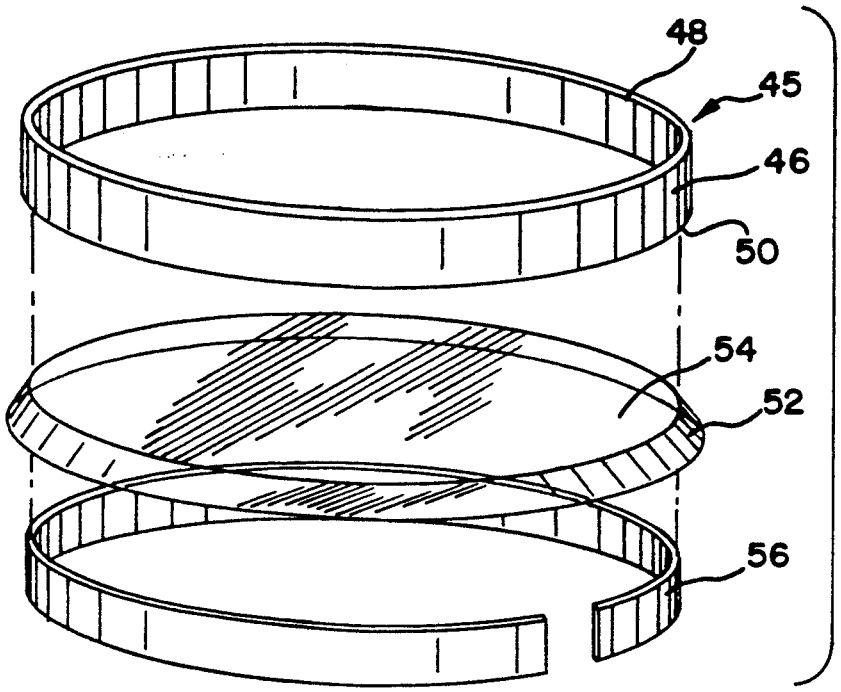
FIG. 3 illustrates the construction of a suitable elements for stretching the typanium of the racket.

FIG. 3 illustrates a drum-head construction or subassembly permitting the flexible membrane can be tautly stretched to provide a tympanum for the racket. For this purpose, a metal ring 46 is provided with its outer dimensions conforming to the frame dimensions of the racket. The ring 46 has a U-shaped cross-section with a rolled edge 48 and an opposite, open annular edge 50 to receive the peripheral margin 52 of the membrane 54. The membrane 54 is laid across the metal ring and is tautly stretched by forcibly extruding the peripheral margin 52 of the membrane 54 into the U-shaped annular edge 50 of the metal ring 46. The membrane 54 is retained within the ring 46 by insertion of an annular wedge 56 which can be of any suitable material, e.g. cardboard which is formed into the open annular edge 50 of the ring 45, firming locking and retaining the peripheral margin 52 of the membrane 54 to the metal ring 46 under a suitably high degree of tension, sufficient to impart the desired reverberating and resonating sound qualities.

Figure 4:
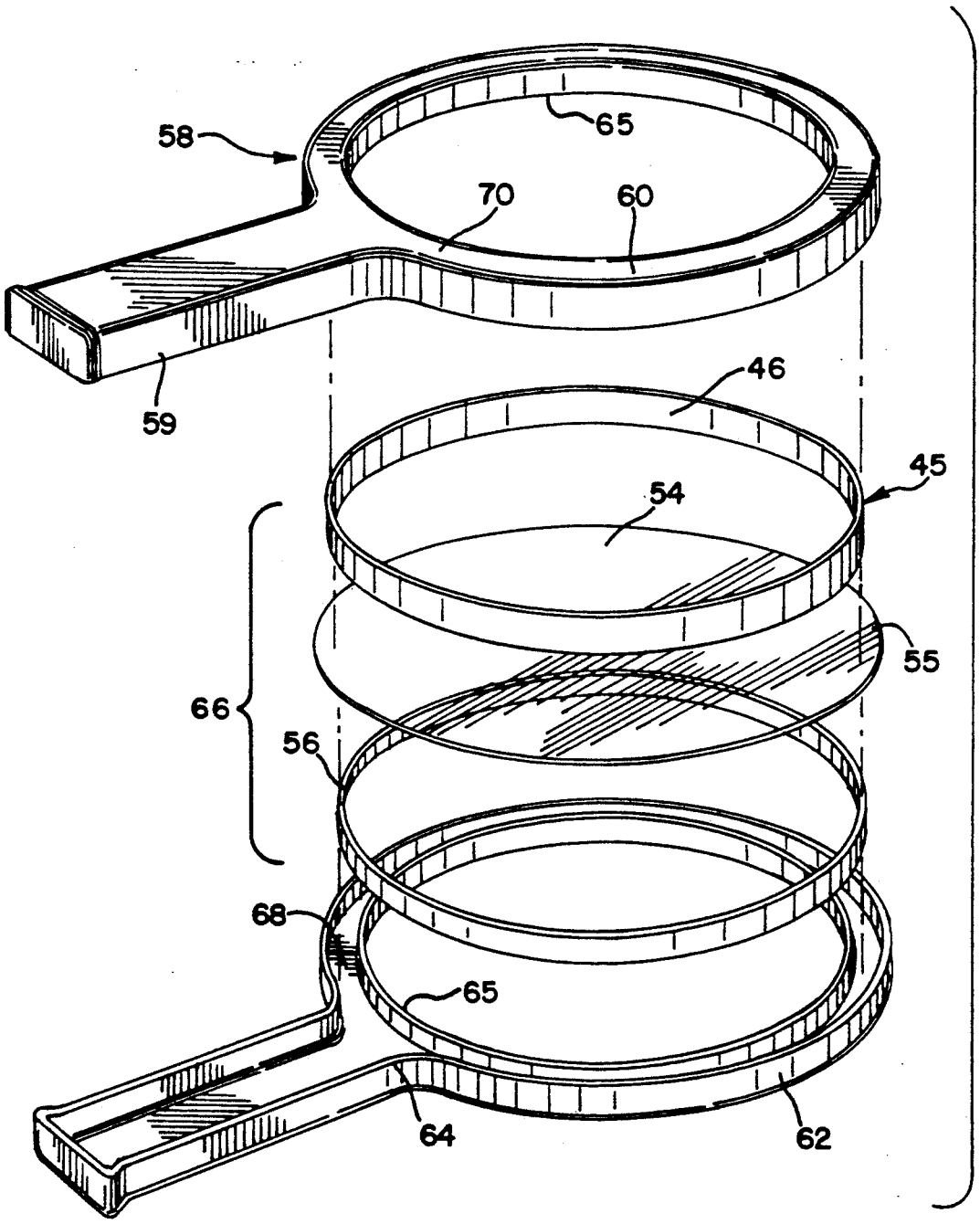
FIG. 4 is an exploded perspective view of the components of a preferred racket.

Referring now to FIG. 4, there is illustrated an exploded view of a racket 58 utilizing the drum-head construction shown in FIG. 3. In this illustration, the racket 50 has a frame 70 which is formed of opposite, mirror-image halves 60 and 62 that are jointed along a longitudinal seam 64, all as described previously with regard to FIG. 1. Each mirror-image half 60 and 62 includes inwardly depending inner ridges 65, which define an annular interior 68 for the frame 70. The inwardly depending inner ridges 65 serve to retain a metal ring 46 within the annular interior 68 of the frame 70. The drum-head 66, which is formed with the metal ring 4 the tympanic membrane 54 and the cardboard annular wedge 56 is located within the annular interior 68 of the hollow form frame 70, and the entire assembly is joined along the longitudinal seam 64, again with suitable means such as solvent or cement bonding, or thermal or ultrasonic welding.

Figure 5:
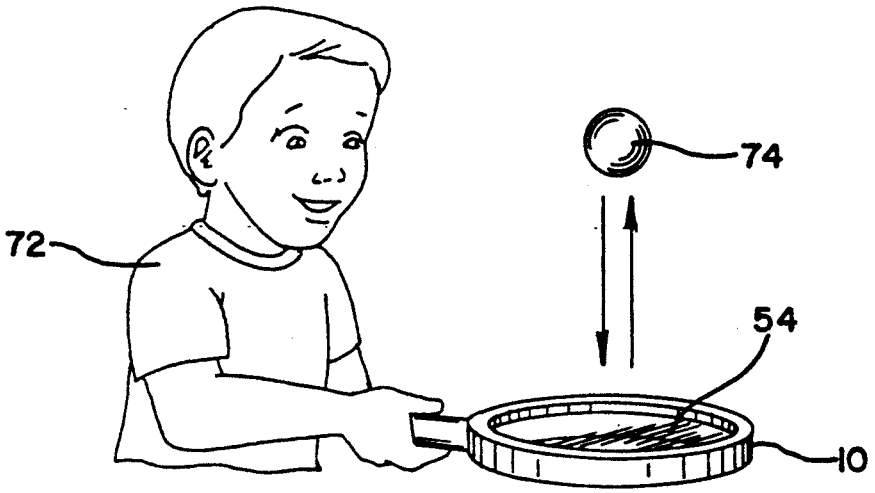
FIG. 5 illustrates a child in solitary play activity with the racket and ball of the invention.

Referring now to FIG. 5, there is illustrated a single player activity in which a child 72 bounces a closed cell foam ball 74 formed of a suitable elastomer such as foam rubber, polyethylene foam, etc. The ball 74 is bounced off the tympanic membrane 54 of the racket 10 generating a booming and resonating sound, similar to that generated by striking the drum-head membrane of a typical drum.

Figure 6:
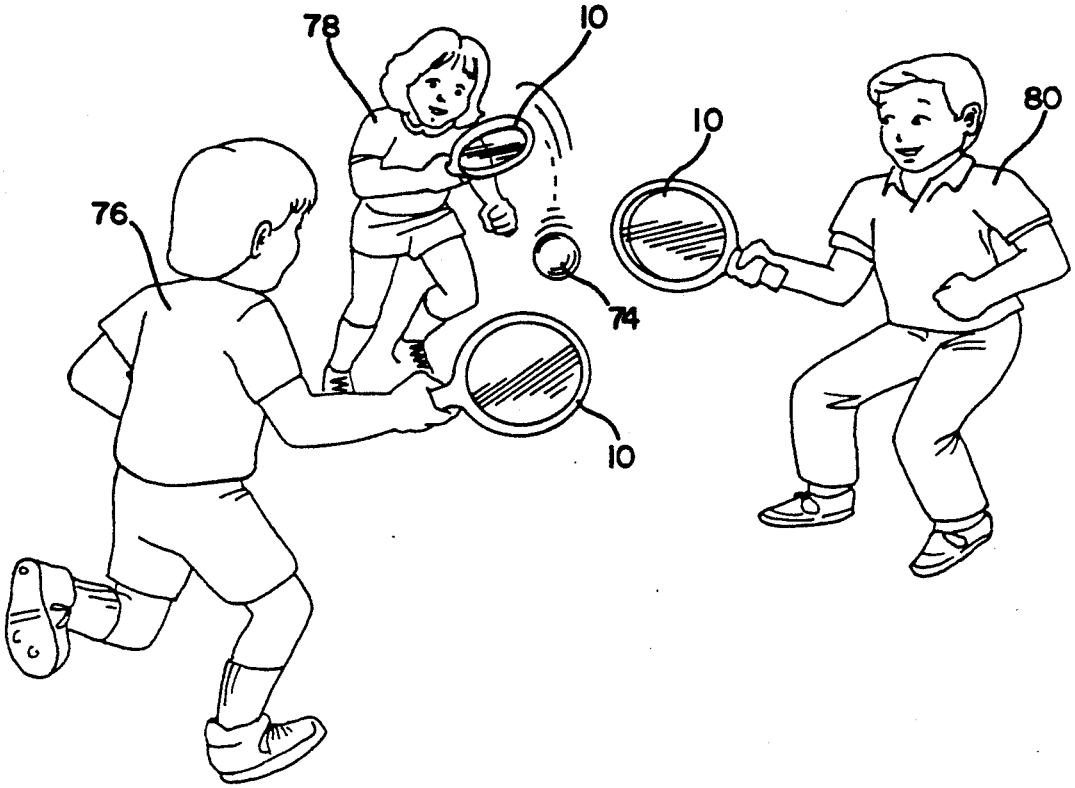
FIG. 6 illustrates a multiple player game using the invention.

Referring now to FIG. 6, there is illustrated a multiple player activity game in which two or more players 76, 78 and 80 are each provided with a racket 10 of the invention and one or more of the plastic foam balls 74 are struck with the rackets by the players, directing the ball 74 to another player with the objective of accuracy of direction of the ball and with a primary objective of generating the loudest sound resonance by striking the ball 74 with the racket 10.

Figure 7:
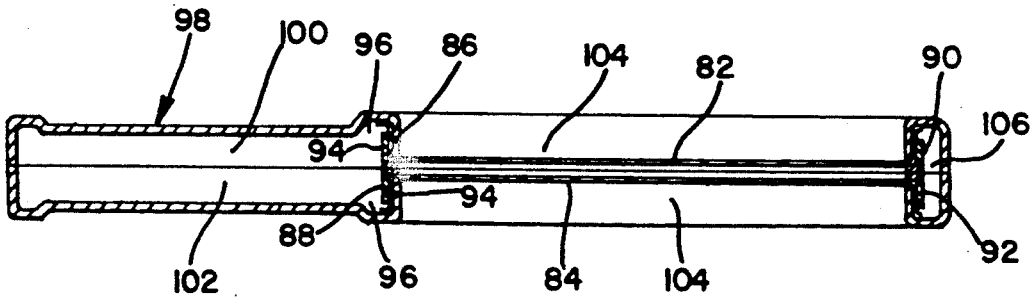
FIG. 7 is a sectional view of another alternative racket having two membranes.

In some applications, it may be desirable to provide a racket with a strong, tear resistant membrane, without compromising the sound resonance quality of the membrane. FIG. 7 illustrates a suitable construction. The racket 98 shown in FIG. 7 is formed of two halves 100 and 102 which are joined along the longitudinal midline of the racket, similar to the racket shown in FIG. 4. The racket 98, however, is provided with two membranes 82 and 84 which are each supported on a respective ring 86 and 88. Preferably, the resulting drum-heads 90 and 92 which are formed by each ring such as 86 and membrane 82 are mounted, back to back, as illustrated, with the resulting annular flange 94 which is formed by each ring being received in the hollow interior 96 of the racket 98. For this purpose, each of the halves 100 and 102 of the racket 98 has an inwardly directed and continuous lip 104 which closely fits within each of the rings. If desired, a thin annular spacer ring 106 can be inserted between the drum-heads to maintain their separation, and this ring 106 can be laminated or otherwise attached to one or both of the drumheads, to prevent its movement in the assembly. The use of two membranes as illustrated greatly strengthens the racket, and avoids the possibility of rupturing a membrane, since the additional membrane greatly strengthens the racket.

The game of the invention provides for safe and fascinating enjoyment by children. The game ball 74 is formed of a soft elastomer which will not cause any injury if a child is struck by the ball. The highly resonating or reverberating sounds achieved by striking the ball captures the attention and fascination of the children, ensuring a prolonged and continued enjoyment of the game.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A toy racket comprising:

a paddle having an outer perimeter frame formed by first and second frame members, the first and second frame members joined together along a longitudinal seam;

a hoop member for insertion between the first and second frame members;

a tympanum formed of a plastic film stretched across and tautly secured to the hoop member, the tympanum and hoop member forming a separate subassembly from the outer perimeter frame; and a handle defined by a rigid longitudinal member attached to the outer perimeter frame, the handle having its longitudinal axis extending outwardly from the frame.

2. The toy racket defined in claim 1, wherein the tympanum defines an impact surface, the impact surface being capable of imparting a reverberating and resonating sound upon impact with a projectile.

3. The toy racket defined in claim 1, wherein the tympanum subassembly defines an acoustical cavity within the outer perimeter frame.

4. The toy racket defined in claim 1, wherein the paddle is formed of molded plastic.

5. The toy racket defined in claim 1, wherein the paddle is hollowform.

6. The toy racket defined in claim 1, wherein the handle is formed of molded plastic.

7. The toy racket defined in claim 1, wherein the handle is hollowform.

8. The toy racket defined in claim 1, wherein the tympanum comprises a transparent plastic film having a thickness from about 0.002 inch to about 0.1 inch.

9. The toy racket defined in claim 1, wherein the plastic film comprises a polyester film.

10. The toy racket defined in claim 1, wherein the plastic film comprises polyethylene.

11. The toy racket of claim 1 including hinge means between said first and second frame members.

12. The toy racket of claim 1 wherein said hoop member is a circular channel having an annular groove, and wherein the peripheral edges of said tympanum are wedged into said annular groove and secured therein with a ring member which is inserted over said tympanum into said groove.

13. The toy racket defined in claim 1, further comprising a solvent, wherein the first and second frame members are joined by said solvent.

14. The toy racket defined in claim 13, wherein the solvent comprises a cement bond.

15. The toy racket defined in claim 1, further comprising a thermal weld, wherein the first and second frame members are joined by said thermal weld.

16. The toy racket defined in claim 1, further comprising an ultrasonic weld, wherein the first and second frame members are joined by said ultrasonic weld.

17. The toy racket defined in claim 1, wherein the first and second frame members each further comprise an inwardly depending inner ridge, the inwardly depending inner ridges defining an annular interior of the outer perimeter frame.

18. The toy racket defined in claim 17, wherein the inwardly depending inner ridges retain the hoop member within the annular interior of the outer perimeter frame.

19. The toy racket defined in claim 1, wherein the outer perimeter frame is substantially circular.

20. The toy racket defined in claim 8, wherein the tympanum bears graphic material.

21. The toy racket defined in claim 1, wherein the tympanum subassembly is secured between the first and second frame members upon assembly.

22. The toy racket defined in claim 1, wherein the first and second frame members comprise opposing, mirror-image halves forming the outer perimeter frame.

* * * * *

UNITED STATES PATENT AND TRADEMARK OFFICE

CERTIFICATE OF CORRECTION

PATENT NO. :5,217,222
DATED :June 8, 1993
INVENTOR(S) :Elliot Rudell et al.

It is certified that error appears in the above-indentified patent and that said Letters Patent is hereby corrected as shown below:

In column 2, line 13, after "10" insert --.--.

In column 2, line 18, after "frame" delete --member--.

In column 3, lines 41 and 42, delete "metal ring 4" and substitute therefor --metal ring 46--.

IN THE CLAIMS: Column 5, line 8,

In claim 11, line 1, after "1" insert --,--.

Column 5, line 10, claim 12, line 1, after "1" insert --, --.

Signed and Sealed this

Twenty-ninth Day of November, 1994

Bruce Lehman

*Attest:*

BRUCE LEHMAN

*Attesting Officer*

*Commissioner of Patents and Trademarks*